US009156653B2

(12) United States Patent
Flynn et al.

(10) Patent No.: US 9,156,653 B2
(45) Date of Patent: Oct. 13, 2015

(54) CONTROLLING ACCESS TO FLOORS WITHIN A BUILDING VIA ELEVATORS

(75) Inventors: Michael P. Flynn, Avon, CT (US); Gary Pisarsky, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 687 days.

(21) Appl. No.: 13/510,402

(22) PCT Filed: Dec. 14, 2009

(86) PCT No.: PCT/US2009/067899

§ 371 (c)(1),
(2), (4) Date: May 17, 2012

(87) PCT Pub. No.: WO2011/075115

PCT Pub. Date: Jun. 23, 2011

(65) Prior Publication Data

US 2012/0241259 A1 Sep. 27, 2012

(51) Int. Cl.
*B66B 1/20* (2006.01)
*B66B 1/46* (2006.01)

(52) U.S. Cl.
CPC ..... *B66B 1/468* (2013.01); *B66B 2201/4623* (2013.01); *B66B 2201/4676* (2013.01)

(58) Field of Classification Search
CPC ..... B66B 2201/103; B66B 2201/4615; B66B 2201/4661; B66B 2201/4676; B66B 2201/4623
USPC ..... 187/247, 380–388, 391, 393
See application file for complete search history.

(56) References Cited

U.S. PATENT DOCUMENTS

| | | | | |
|---|---|---|---|---|
| 4,979,594 | A * | 12/1990 | Begle et al. | 187/380 |
| 5,200,583 | A | 4/1993 | Kupersmith et al. | |
| 5,689,094 | A | 11/1997 | Friedli et al. | |
| 5,749,443 | A | 5/1998 | Romao | |
| 6,062,346 | A | 5/2000 | Friedli et al. | |
| 6,315,083 | B1 | 11/2001 | Schuster et al. | |
| 6,707,374 | B1 | 3/2004 | Zaharia | |
| 6,772,862 | B2 * | 8/2004 | Friedli | 187/247 |

(Continued)

FOREIGN PATENT DOCUMENTS

| | | | |
|---|---|---|---|
| CN | 1715166 | A | 1/2006 |
| CN | 101287666 | A | 10/2008 |

(Continued)

OTHER PUBLICATIONS

Article by Paul Friedli and Kilian Schuster entitled The Evolution of the Passenger Interface with the Elevator:, TUE, vol. 37 (1996), No. 10 (October), pp. 17-20.

(Continued)

*Primary Examiner* — Anthony Salata
(74) *Attorney, Agent, or Firm* — Cantor Colburn LLP

(57) ABSTRACT

The present invention relates to a method of controlling access to floor within a building via elevator. The method includes receiving a passenger input indicating a desired destination floor a passenger seeks to travel to in an elevator, accessing a stored database containing data about which floors passengers are allowed to access via elevator when coming from the floor of the passenger input, determining if access is allowed based upon the desired destination floor and the data, and controlling operation of the elevator to deliver the passenger to the desired destination floor if access is allowed.

17 Claims, 6 Drawing Sheets

(56) References Cited

U.S. PATENT DOCUMENTS

| | | | | |
|---|---|---|---|---|
| 7,025,180 | B2 | 4/2006 | Wyss et al. | |
| 7,190,256 | B2 * | 3/2007 | Pieper | 340/5.7 |
| 7,581,622 | B2 * | 9/2009 | Amano | 187/384 |
| 7,936,249 | B2 * | 5/2011 | Friedli | 340/5.5 |
| 8,061,485 | B2 * | 11/2011 | Finschi | 187/384 |
| 8,464,840 | B2 * | 6/2013 | Flynn et al. | 187/384 |
| 8,770,350 | B2 * | 7/2014 | Wilke et al. | 187/384 |
| 2012/0228065 | A1 * | 9/2012 | Tokura | 187/384 |
| 2012/0228066 | A1 * | 9/2012 | Mitsuda et al. | 187/389 |
| 2013/0048435 | A1 | 2/2013 | Finschi | |
| 2013/0068569 | A1 * | 3/2013 | Nakashima | 187/389 |
| 2014/0054116 | A1 * | 2/2014 | Wu | 187/392 |

FOREIGN PATENT DOCUMENTS

| | | | |
|---|---|---|---|
| EP | 0699617 | A1 | 3/1996 |
| EP | 1666398 | A1 | 6/2006 |
| JP | H07237837 | | 9/1995 |
| JP | 2004123330 | A | 4/2004 |
| JP | 2006-096505 | A | 4/2006 |
| JP | 2006096505 | A | 4/2006 |
| JP | 2007084179 | A | 4/2007 |
| JP | 2008050066 | A | 3/2008 |
| KR | 20-0417893 | Y1 | 6/2006 |
| KR | 10-20060081041 | A | 7/2006 |
| KR | 10-0643125 | B1 | 11/2006 |
| WO | 2007014477 | A2 | 2/2007 |
| WO | 2007036057 | A1 | 4/2007 |
| WO | WO 2006/059983 | A2 | 6/2008 |
| WO | 2011075115 | A1 | 6/2011 |

OTHER PUBLICATIONS

Article by Dr-Ing-Joris Schroder entitled "Advanced Dispatching", Schindler Management AG, Ebikon/Lucerne, Switzerland.
International Search Report, mailed Aug. 10, 2010.
English Translation of Japanese Office Action, mailed Dec. 3, 2013.
Canadian Office Action, dated Oct. 17, 2013.
Notification of Reasons for Refusal from KR Patent Application Serial No. 10-2012-7016481, dated Jul. 31, 2013, 10 pages.
Translation of Chinese Office Action for application CN200980162887.1, mailed Dec. 13, 2013, 9 pages.
Translation of Chinese Search Report for application CN2009801629887.1, Dec. 3, 3 pages.

* cited by examiner

| FROM \ TO | F1 | F2 | F3 | F4 | F5 | F6 | F7 | F8 | F9 | F10 | F11 | F12 | F13 | F14 | F15 | F16 | F17 | F18 | F19 | F20 |
|---|---|---|---|---|---|---|---|---|---|---|---|---|---|---|---|---|---|---|---|---|
| F1(VAULT) | X | N | N | N | N | N | N | N | N | N | N | N | N | N | N | N | N | N | N | N |
| F2(LOBBY) | N | X | N | N | N | N | N | AA | N | N | N | N | N | N | N | N | N | N | N | N |
| F3 | N | O | X | N | N | N | N | AA | N | N | N | N | N | N | N | N | N | N | N | N |
| F4 | N | O | N | X | N | N | N | AA | N | N | N | N | N | N | N | N | N | N | N | N |
| F5 | N | O | N | N | X | N | N | AA | N | N | N | N | N | N | N | N | N | N | N | N |
| F6 | N | O | N | N | N | X | N | AA | N | N | N | N | N | N | N | N | N | N | N | N |
| F7 | N | O | N | N | N | N | X | AA | N | N | N | N | N | N | N | N | N | N | N | N |
| F8 | N | O | N | N | N | N | N | X | N | N | N | N | N | N | N | N | N | N | N | N |
| F9 | N | O | N | N | N | N | N | AA | X | N | N | N | N | N | N | N | N | N | N | N |
| F10 | N | O | N | N | N | N | N | AA | N | X | N | N | N | N | N | N | N | N | N | N |
| F11 | N | O | N | N | N | N | N | AA | N | N | X | N | N | N | N | N | N | N | N | N |
| F12 | N | O | N | N | N | N | N | AA | N | N | N | X | N | N | N | N | N | N | N | N |
| F13 | N | O | N | N | N | N | N | AA | N | N | N | N | X | N | N | N | N | N | N | N |
| F14 | N | O | N | N | N | N | N | AA | N | N | N | N | N | X | N | N | N | N | N | N |
| F15 | N | O | N | N | N | N | N | AA | N | N | N | N | N | N | X | N | N | N | N | N |
| F16 | N | O | N | N | N | N | N | AA | N | N | N | N | N | N | N | X | N | N | N | N |
| F17 | N | O | N | N | N | N | N | AA | N | N | N | N | N | N | N | N | X | N | N | N |
| F18 | N | O | N | N | N | N | N | AA | N | N | N | N | N | N | N | N | N | X | N | N |
| F19 | N | O | N | N | N | N | N | AA | N | N | N | N | N | N | N | N | N | N | X | N |
| F20 | N | O | N | N | N | N | N | AA | N | N | N | N | N | N | N | N | N | N | N | X |

| | |
|---|---|
| AA | = AUTHORIZATION AND ALLOWED |
| N | = NOT ALLOWED (NOT AUTHORIZED) |
| O | = OPEN FLOOR |

*Fig. 2*

| FROM \ TO | F1 | F2 | F3 | F4 | F5 | F6 | F7 | F8 | F9 | F10 | F11 | F12 | F13 | F14 | F15 | F16 | F17 | F18 | F19 | F20 |
|---|---|---|---|---|---|---|---|---|---|---|---|---|---|---|---|---|---|---|---|---|
| F1 | X | | | | | | | | | | | | | | | | | | | |
| F2(CLEAN) | | X | | AA | | N | | | | | | | | | | | | | | |
| F3 | | | X | | | | | | | | | | | | | | | | | |
| F4(SURGERY) | | AA | | X | | | | | | | | | | | | | | | | |
| F5 | | | | | X | | | | | | | | | | | | | | | |
| F6 (DIRTY) | | N | | N | | X | | | | | | | | | | | | | | |
| F7 | | | | | | | X | | | | | | | | | | | | | |
| F8 | | | | | | | | X | | | | | | | | | | | | |
| F9 | | | | | | | | | X | | | | | | | | | | | |
| F10 | | | | | | | | | | X | | | | | | | | | | |
| F11 | | | | | | | | | | | X | | | | | | | | | |
| F12 | | | | | | | | | | | | X | | | | | | | | |
| F13 | | | | | | | | | | | | | X | | | | | | | |
| F14 | | | | | | | | | | | | | | X | | | | | | |
| F15 | | | | | | | | | | | | | | | X | | | | | |
| F16 | | | | | | | | | | | | | | | | X | | | | |
| F17 | | | | | | | | | | | | | | | | | X | | | |
| F18 | | | | | | | | | | | | | | | | | | X | | |
| F19 | | | | | | | | | | | | | | | | | | | X | |
| F20 | | | | | | | | | | | | | | | | | | | | X |

| | |
|---|---|
| AA | = AUTHORIZATION AND ALLOWED |
| N | = NOT ALLOWED |
| O | = OPEN FLOOR |

Fig. 3

| FROM \ TO | F1 | F2 | F3 | F4 | F5 | F6 | F7 | F8 | F9 | F10 | F11 | F12 | F13 | F14 | F15 | F16 | F17 | F18 | F19 | F20 |
|---|---|---|---|---|---|---|---|---|---|---|---|---|---|---|---|---|---|---|---|---|
| F1 (GARAGE) | X | O | O | | | | | | | | | | | | | | | | | N |
| F2 (LOBBY) | O | X | O | | | | | | | | | | | | | | | | | N |
| F3 (SECURITY) | | | X | | | | | | | | | | | | | | | | | AA |
| F4 | | | | X | | | | | | | | | | | | | | | | |
| F5 | | | | | X | | | | | | | | | | | | | | | |
| F6 | | | | | | X | | | | | | | | | | | | | | |
| F7 | | | | | | | X | | | | | | | | | | | | | |
| F8 | | | | | | | | X | | | | | | | | | | | | |
| F9 | | | | | | | | | X | | | | | | | | | | | |
| F10 | | | | | | | | | | X | | | | | | | | | | |
| F11 | | | | | | | | | | | X | | | | | | | | | |
| F12 | | | | | | | | | | | | X | | | | | | | | |
| F13 | | | | | | | | | | | | | X | | | | | | | |
| F14 | | | | | | | | | | | | | | X | | | | | | |
| F15 | | | | | | | | | | | | | | | X | | | | | |
| F16 | | | | | | | | | | | | | | | | X | | | | |
| F17 | | | | | | | | | | | | | | | | | X | | | |
| F18 | | | | | | | | | | | | | | | | | | X | | |
| F19 | | | | | | | | | | | | | | | | | | | X | |
| F20 | | | | | | | | | | | | | | | | | | | | X |

| | |
|---|---|
| AA | = AUTHORIZATION AND ALLOWED |
| N | = NOT ALLOWED (NOT AUTHORIZED) |
| O | = OPEN FLOOR |

Fig. 4

| FROM \ TO | F1 | F2 | F3 | F4 | F5 | F6 | F7 | F8 | F9 | F10 | F11 | F12 | F13 | F14 | F15 | F16 | F17 | F18 | F19 | F20 |
|---|---|---|---|---|---|---|---|---|---|---|---|---|---|---|---|---|---|---|---|---|
| F1 | X | O | O | O | O | O | N | N | N | O | O | N | N | N | N | N | N | N | N | O |
| F2 | O | X | O | O | O | N | N | N | N | O | O | N | N | N | N | N | N | N | N | O |
| F3 | O | O | X | O | O | N | N | N | N | O | O | N | N | N | N | N | N | N | N | O |
| F4 | O | O | O | X | O | N | N | N | N | O | O | N | N | N | N | N | N | N | N | O |
| F5 | O | O | O | O | X | N | N | N | N | O | O | N | N | N | N | N | N | N | N | O |
| F6 | O | N | N | N | N | X | O | O | O | O | O | N | N | N | N | N | N | N | N | O |
| F7 | N | N | N | N | N | O | X | O | O | O | O | N | N | N | N | N | N | N | N | O |
| F8 | N | N | N | N | N | O | O | X | O | O | O | N | N | N | N | N | N | N | N | O |
| F9 | N | N | N | N | N | O | O | O | X | O | O | N | N | N | N | N | N | N | N | O |
| F10 | O | O | O | O | O | N | N | N | N | X | O | N | N | N | N | N | N | N | N | O |
| F11 | O | O | O | O | O | N | N | N | N | O | X | AA | AA | AA | AA | AA | AA | AA | O | O |
| F12 | O | N | N | N | N | N | N | N | N | O | O | X | AA | AA | AA | AA | AA | AA | O | O |
| F13 | O | N | N | N | N | N | N | N | N | O | O | AA | X | AA | AA | AA | AA | AA | O | O |
| F14 | O | N | N | N | N | N | N | N | N | O | O | AA | AA | X | AA | AA | AA | AA | O | O |
| F15 | O | N | N | N | N | N | N | N | N | O | O | AA | AA | AA | X | AA | AA | AA | O | O |
| F16 | O | N | N | N | N | N | N | N | N | O | O | AA | AA | AA | AA | X | AA | AA | O | O |
| F17 | O | N | N | N | N | N | N | N | N | O | O | AA | AA | AA | AA | AA | X | AA | O | O |
| F18 | O | N | N | N | N | N | N | N | N | O | O | AA | AA | AA | AA | AA | AA | X | O | O |
| F19 | O | N | N | N | N | N | N | N | N | O | O | AA | AA | AA | AA | AA | AA | AA | X | O |
| F20 | O | O | O | O | O | N | N | N | N | O | O | N | N | N | N | N | N | N | N | X |

| | |
|---|---|
| AA | =AUTHORIZATION AND ALLOWED |
| N | =NOT ALLOWED |
| O | =OPEN FLOOR |

| FLOOR | |
|---|---|
| F1 | LOBBY |
| F2 - F5 | BUSINESS (B1) |
| F6 - F9 | BUSINESS (B2) |
| F10 | FITNESS CENTER |
| F11 - F19 | HOTEL |
| F19 | HOTEL POOL |
| F20 | RESTAURANT |

Fig. 5

| | | TO | | | | | | | | | |
|---|---|---|---|---|---|---|---|---|---|---|---|
| | FLOOR | F1 | F2 | F3 | F4 | F5 | F6 | F7 | F8 | F9 | F10 |
| FROM | F1 | X | O | O | O | AA | AA | AA | O | N | N |
| | F2 | O | X | O | O | AA | AA | AA | O | N | N |
| | F3 | O | O | X | O | AA | AA | AA | O | N | N |
| | F4 | O | O | O | X | AA | AA | AA | O | N | N |
| | F5 | O | O | O | O | X | O | O | O | N | N |
| | F6 | O | O | O | O | O | X | O | O | N | N |
| | F7 | O | O | O | O | O | O | X | O | N | N |
| | F8 | O | O | O | O | AA | AA | AA | X | O | O |
| | F9 | N | N | N | N | N | N | N | O | X | O |
| | F10 | N | N | N | N | N | N | N | O | O | X |

| | |
|---|---|
| AA | =AUTHORIZATION AND ALLOWED |
| N | =NOT ALLOWED |
| O | =OPEN FLOOR |

| FLOOR | |
|---|---|
| F1 | LOBBY |
| F2 - F3 | LECTURE HALLS |
| F4 | LAB |
| F5 - F7 | FACULTY OFFICES |
| F8 - F10 | LIBRARY |

*Fig. 6*

CONTROLLING ACCESS TO FLOORS WITHIN A BUILDING VIA ELEVATORS

BACKGROUND OF THE INVENTION

The present invention generally relates to elevator systems, and more particularly to elevator security systems within elevator systems.

Typical elevator systems work to transport passengers from one floor to another within a building. A passenger call is generated, indicating the floor on which the passenger wishes to be picked up by the elevator, and an elevator responds. The passenger usually indicates a desired destination floor either when the call is generated or upon entering the elevator which responds. The elevator then transports the passenger to the desired destination floor.

Some elevator systems serve buildings in which access to some or all floors of a building is regulated, and authorization is required for persons who wish to access these floors via elevator. When only certain persons are allowed access to these floors, there are a variety of methods used to grant or deny access to certain desired destination floors. Some of these methods include using an identification system in which the elevator recognizes whether the passenger is a person who is authorized to access that particular floor from the elevator. In some systems, an identification card is used or a security code may be entered which allows the passenger access to the regulated floor. In other systems, elevators may transport passengers to all floors, and upon arriving at a regulated floor, the passenger will encounter another type of security system to grant or deny the passenger access. Some systems may even designate certain elevators to only access unregulated floors, and have another set of elevators which can access the regulated floors for authorized passengers.

BRIEF SUMMARY OF THE INVENTION

A method of controlling access to floors within a building via elevator includes receiving a passenger input indicating a desired destination floor that a passenger seeks to travel to in an elevator, accessing a stored database containing data about which floors passengers are allowed to access via elevator when coming from the floor of the passenger input, determining if access is allowed based upon the desired destination floor and the data, and controlling operation of the elevator to deliver the passenger to the desired destination floor if access is allowed.

An embodiment of the present invention relates to an elevator security system. The system includes an elevator for transporting a passenger from one floor to another floor within a building, an input device through which a passenger can input a desired destination floor, and a system for controlling access to floors by the passenger in the elevator. Desired destination floor access is allowed or not allowed based on accessing a stored database containing data about which floors elevators are allowed to access via elevator when coming from the floor of the passenger input.

BRIEF DESCRIPTION OF THE DRAWINGS

FIG. 2 is a data matrix used in an elevator security system for a bank building according to the present invention.

FIG. 3 is a data matrix used in an elevator security system for a hospital according to the present invention.

FIG. 4 is a data matrix used in an elevator security system for an office building according to the present invention.

FIG. 5 is a data matrix used in an elevator security system for a multi-function building according to the present invention.

FIG. 6 is a data matrix used in an elevator security system for a university building according to the present invention.

DETAILED DESCRIPTION

Figure 1:
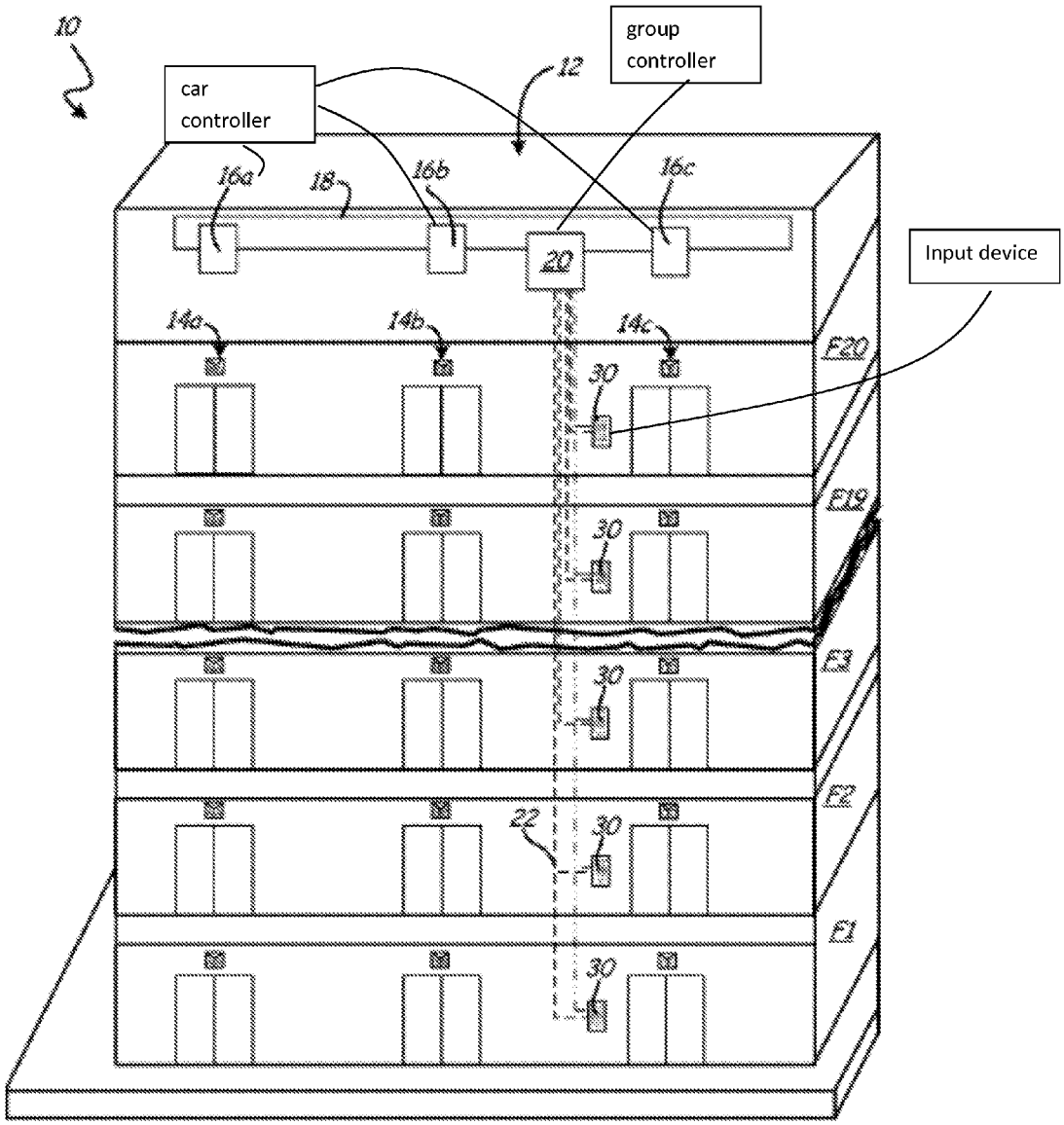
FIG. 1 is a diagram of a multi-story building with an elevator security system according to the present invention.

The present invention provides a method of controlling access to floors within a building via elevator. Typically, when access is regulated to certain floors in an elevator system, security is destination based. Access via elevator to a passenger's desired destination floor is granted or denied based on one or more authorization methods, including passenger recognition, identification cards, and/or entering security codes to be authorized to enter the desired destination. The method of the current invention grants or denies access to a desired destination floor within a building via elevator based on stored data showing which floors a passenger is granted access to based on which floor the passenger is coming from.

FIG. 1 is a perspective view of elevator system 10 in building 12. Building 12 includes twenty floors in total (F1-F20), with a break shown between floors F3 and F19 for purposes of fitting the figure on the page. Group elevator system 10 includes three elevators 14*a*, 14*b*, and 14*c*, each of which is operable to transport passengers to any of the floors in building 12. While three elevators 14*a*-14*c* and twenty floors are shown, it will be appreciated that the present invention is applicable to destination entry group elevator systems with any number of elevators servicing any number of floors. Group elevator system 10 further includes car controllers 16*a*-16*c*, group controller 20, communications loop 18, communications lines 22 and desired destination input devices 30.

Desired destination input devices 30 are connected to group controller 20 through communications lines 22. Input devices 30 can also be wireless (and would then not require communications lines 22). Group controller 20 is connected to car controllers 16*a*-16*c* through communications loop 18. Car controller 16*a* is connected to car 14*a*, car controller 16*b* is connected to car 14*b*, and car controller 16*c* is connected to car 14*c*.

Desired destination input devices 30 are located next to the elevators on each floor and are used by passengers to indicate a desired destination floor which the passenger seeks to travel to. Group controller 20 receives and processes this information delivered via communications lines 22. Group controller 20 then provides car controllers 16*a*-16*c* with elevator control information based on the destination input information received and data from a stored database (not shown) containing information about which floors passengers are allowed to access via elevator when coming from the floor on which the desired destination input originated. Car controllers 16*a*-16*c* control elevators 14*a*-14*c*, respectively, based on elevator control information received from group controller 20. If controller 20 determines access is allowed to the desired destination floor when coming from the floor on which the desired destination input originated (based on the stored data), controller 20 will send control information to one of car controllers 16*a*-16*c* to control operation of the elevator to transport the passenger to the desired destination floor. If access is not allowed, controller 20 will send information to one of car controllers 16*a*-16*c* to control operation of the elevator to not transport the passenger to the desired destination floor (this may include: controlling the elevator to not respond to the call or controlling the elevator to not move between floors and to leave the elevator car doors open on the floor which passenger entered the elevator). While in this embodiment, accessing the stored database and determining if access is granted to the desired destination floor is done by group controller 20, it could be done by a different system, such as a security system, which interfaces with group controller 20.

The desired destination input 30 may be a device which the passenger enters the desired destination floor into or it may simply be conventional up and down hall call buttons, which the passenger uses to signal the direction of the desired destination floor. If the desired destination input is conventional up and down hall call buttons, the determination of whether access is granted to a desired destination floor will be made when the passenger enters an elevator and presses a button to indicate a desired destination floor.

In the invention of the second embodiment, after a passenger input indicating a desired destination floor has been received, a stored database is accessed to determine whether the passenger is allowed to access the desired destination floor via elevator. This stored database contains data relating to two pieces of information: whether an elevator can transport passengers from the floor on which the input originated to the desired destination floor and whether a particular passenger is authorized to access the desired destination floor. The information can also be stored in separate databases. This information is illustrated in FIGS. 2-6 with a matrix designating possible elevator transports with a "N," "O," or "AA." The designation "N" indicates the car may not transport passengers from the input origination floor to the desired destination floor. "O" indicates that the car may transport passengers from the origination floor to the desired destination floor without the need for further authorization. "AA" means that a car may transport passengers from the input floor to the desired destination floor only if that passenger is authorized to access the desired destination floor.

By accessing this stored database, the elevator system controls access to desired destination floors based on the floor on which the call originated (as well as authorization). This can be useful in a number of applications relating to security and different access levels, including a bank, a hospital, an office building, a multi-function building and a university building.

FIG. 2 is one embodiment of data (displayed here in matrix form) stored in the database for determining if access to a particular desired destination floor is allowed based on the floor from which the input originated. This data matrix represents the access level for passenger P, a bank employee to the bank building, including floors F1-F20. Floor F1 is the bank vault, F2 is the lobby, and F8 is the floor upon which passenger "P" works. The vertical "From" side represents the floor on which the input originated (the floor from which the passenger wants to travel). The horizontal "To" side represents the desired destination floor of the passenger (the floor to which the passenger wants to travel) as indicated from the passenger desired destination floor input. "AA" in the matrix stands for authorization and allowed, meaning that passenger P has authorization to enter that floor and is allowed to go to that floor. "N" stands for not allowed, meaning travel to that particular floor from the floor on which the passenger is entering the elevator is not allowed. "O" stands for open, meaning that travel to that desired destination floor from that entry floor is allowed. Authorization is used when only certain persons are allowed access to a floor, and can be used in addition to the system of granting access based on data stored regarding which floors passengers are allowed to access via elevator when coming from the floor at which the desired destination input originated. Authorization required to gain access to certain floors may be provided in many forms, including, but not limited to, scanning an identification badge or inputting a security code. If the passenger has the proper authorization, access to that floor is allowed. If the passenger does not, access to the desired destination floor is not allowed.

When a passenger input indicating a desired destination floor to which a passenger seeks to travel via elevator is received, this data matrix (stored in a database) is accessed. The matrix is used to determine if access to the desired destination floor is allowed. The floor on which the passenger input originated is located on the vertical "From" side of the matrix. The desired destination floor is located on the horizontal "To" side of the matrix. The square in which the "From" floor crosses paths with the "To" floor in the matrix, determines if access is granted to the desired destination floor from the input origination floor via elevator. If the square contains an "O" access is allowed, and the elevator is controlled to transport the passenger from the input origination floor to the desired destination floor. If the square contains "N," access is not granted and the elevator is controlled to not transport the passenger from the input origination floor to the desired destination floor. If the square contains an "AA," proper authorization must be accepted before elevator is controlled to transport passenger from the input origination floor to the desired destination floor.

FIG. 2 shows a matrix specifically for passenger P who works on floor F8. As can be seen in the matrix, passenger P is authorized and allowed to be transported from lobby F2 to F8 to go to work. Passenger P is also authorized and allowed to travel to his work floor F8 from any other floor of the bank via elevator. Passenger P is allowed to travel from his work floor F8 (or any other floor) to the lobby, as that square in the matrix contains an "O," meaning authorization is not required to travel via elevator from that floor to lobby F2. However, passenger P cannot travel from the lobby to the vault or from the vault to the lobby, as the vault is not a destination a passenger can travel to from the lobby, and the lobby is not a destination a passenger can travel to from the vault (F1) via elevator (as indicated by "N"). Passenger P also cannot travel from the vault to his work floor F8, even though he is authorized to go to that floor normally. This helps to ensure the bank vault is secure by only allowing travel to and from the vault to be to and from certain floors (such as a security floor). Passenger P is not allowed to travel from lobby F2 to any bank floor that is not his work floor (F3-F7, and F9-F20). Passenger P is also not allowed travel via elevator from any floor that is not his work floor (F8) or lobby F2 to any other floor that is not his work floor F8 or lobby F2.

The determination of whether access to a floor via elevator is granted (done by accessing data in the stored database) can be performed directly by the elevator controller. It could also be performed by another system, such as a security system, which interfaces with the elevator controller. The data stored in the database is able to be modified, enabling the system to easily adapt to different needs of a particular building concerning granting access to different floors based on the origination floor.

FIG. 3 illustrates a data matrix used in an elevator security system for a hospital according to the present invention which is used to control access to the various hospital floors within the hospital. The hospital includes 20 floors, floors F1-F20. These include floor F2, which is a clean floor where sterile materials are stored; F4, a surgery floor on which only sterile materials are permitted; and F6 which is a dirty floor where contaminated equipment is kept. The "From" side of the matrix represents the floor from which the passenger desires to travel via elevator. The "To" side represents the desired destination floor to which passenger desires to travel via elevator. "AA" in the matrix stands for authorization and allowed. "N" stands for not allowed.

As can be seen in the matrix, when a person is desiring to travel from F2, the clean floor, to F4, the surgery floor, the matrix would show an "AA." This means that the person is allowed to travel from F2 to F4 if they have the proper authorization. Travel (with the proper authorization) from F2 to F4 is allowed, as the clean floor has sterile materials and only sterile materials are allowed on surgery floor F4. However, a person desiring to travel from F2 to F6, the dirty floor, would encounter an "N" in the matrix. This means that travel from F2 to F6 is not allowed. This is to keep the sterile materials on F2 from going to F6 and possibly becoming contaminated. Conversely, a passenger would not be able to travel to clean floor F2 or surgery floor F4 from dirty floor F6. This is to prevent contamination of clean floor F2 and surgery floor F4 from the contaminants on dirty floor F6. Travel via elevator from surgery floor F4 to F2 is also allowed if authorized.

FIG. 4 is a data matrix for an office building according to the present invention. The office building has twenty floors, F1-F20. Floor F1 is a garage, F2 is a lobby, F3 is security and executive offices are on F20. The "From" side of the matrix represents the floor from which the passenger desires to travel via elevator. The "To" side represents the desired destination floor to which passenger desires to travel via elevator. "AA" stands for authorization and allowed. "N" stands for not allowed. "O" stands for open floor.

As can be seen in the matrix, executive "E" is able to travel via elevator from the garage F1 or the lobby F2 only to security floor F3 (or between garage F1 and lobby F2, as these moves contain an "O"). Executive E is not able to travel directly to her office on floor F20 from the garage F1 or lobby F2, because although she has authorization to enter F20 travel via elevator from garage F1 or lobby F2 to F20 is not allowed (N). She must first go through security on floor F3, and then may travel to her office on floor F20. This enables a more secure office, first making persons entering the building (through the lobby or garage) check in with security before proceeding to other floors.

FIG. 5 is an embodiment of a data matrix according to the present invention applicable to a multi-function building and used to control access to floors within that building. The building includes 20 floors. F1 is the lobby. Floors F2-F5 are a business ("B1"), and floors F6-F9 are a different business ("B2"). Floor F10 is a fitness center. Floors F11-F19 are a hotel, with F11 being the hotel lobby and F19 being the hotel pool. Floor F20 is a restaurant. "O" in the matrix stands for open access. "N" stands for not allowed access. "AA" represents that some type of authorization is required for access to be allowed. The "From" side of the matrix represents the floor from which the passenger desires to travel via elevator. The "To" side represents the desired destination floor to which passenger desires to travel via elevator.

B1 on F2-F5 grants access to any of F2-F5 when the input originates from lobby F1, fitness center on F10, hotel lobby on F11 or restaurant on F20. B1 could represent a retail business of some sort which would allow open access to all desiring to come to B1.

B2 on F6-F9 is a more secure business. Access to B2 via elevator (from a floor not within B2) is allowed only when coming from the lobby to F6. F6 may contain some kind of reception desk or security to ensure only those who work at B2 are allowed to access the other floors of B2 (F7-F9). However, when the passenger input originates from a floor already within B2, open access is allowed to any other floor within B2 (F6-F9).

F10 holds a fitness center which is open to public membership. Therefore, access is open to F10 when the passenger call originates on any other floor. The hotel lobby on F11, and the restaurant on F20 is much the same, allowing access to these floors via elevator from any other floor.

The hotel on F11-F19 includes the hotel lobby on F11, guest rooms on F12-F18 and the hotel pool on F19. Guests must first enter the hotel at the hotel lobby on F11, as access to all other hotel floors is not allowed when coming from any floor not in the hotel (F1-F10 and F20). Once in the hotel lobby, access to the hotel pool via elevators is open. Access to floors containing guest rooms (F12-F18) requires some sort of authorization, indicating the guest is staying at a room on that floor.

This embodiment demonstrates how the elevator system of the present invention can efficiently and effectively service a multi-function building by controlling access to floors within that building via elevators. The system controls access to different floors in a building by accessing stored data to determine which floors passengers are allowed to access when coming from the floor on which the passenger input originated. The data matrix is easily modifiable as the needs of the building and building tenants change. The system of the current invention can also serve to eliminate the need to install multiple sets of elevators, where each business has its own set of elevators for security reasons.

FIG. 6 is an embodiment of a data matrix according to the present invention applicable to a university building and used to control access to floors within that building. The building includes 10 floors: F1 is a lobby; F2 and F3 are lecture halls; F4 is a lab; F5-F7 are faculty offices; and F8-F10 are a library. The "From" side of the matrix represents the floor from which the passenger desires to travel via elevator. The "To" side represents the desired destination floor to which passenger desires to travel via elevator. "O" in the matrix stands for open access. "N" represents not being allowed access. "AA" represents that authorization is required for access (for an explanation of authorization and examples of authorization required, see FIG. 2 above).

As can be seen in the matrix, coming from the lobby via elevator, access is open to the lecture halls (F2-F3), lab (F4) and first floor of the library (F8). These are all destinations likely frequented by students, and therefore need to be easily accessible to them via elevator. To access faculty offices (F5-F7) from any other floors (F1-F4 and F8), authorization is required. This ensures that only those with proper authorization are allowed to travel to F5-F7 from any other floor, but also allows faculty (or others) already on F5-F7 to easily travel via elevator between F5-F7 without the need for showing authorization every time.

Because libraries are concerned with the security of books, there is frequently one entrance and exit to a library so that anyone leaving with a book properly checks out that book. This system allows for a secure library entrance and exit on F8. Access to travel to F8 (the library entrance) via elevator is open when coming from any floor. To travel to the other floors of the library, one must first stop at F8. Access to travel directly to F9 or F10 is not allowed. Once on F8, access to F9 and F10 is open. When desiring to exit the library, persons must first travel to F8, presumably exit the secure library exit (checking out any books), and then those persons are allowed access to other floors via elevators. Access to any floor below F8 when entering the elevator on F9 or F10 is not allowed.

This system allows for an origination floor based method to control access to floors within a university building via elevators. University buildings tend to have unique needs for elevator systems, as they must efficiently handle a large number of persons and provide access to an ever-changing student body to certain areas while keeping other areas secure. This origination floor based method of controlling access to floors facilitates allowing access via elevators to areas which students frequent without having to grant access individually to each student in the always-changing student body. This system also provides a simple solution for the unique security needs of individual areas such as faculty offices and the library.

These examples above (a bank building, a hospital, an office building, a multi-function building, and a university building) show different embodiments of the method of controlling access to floors within a building via elevator, as well as the elevator security system of the current invention. The system of the current invention (which grants access to certain floors via elevator based on stored data and the floor which a passenger is coming from) could be useful in many other situations, including in a stadium where athletes and team personnel are granted different levels of access and come from different origination floors than fans, and in a church where the congregation and different church personnel would be granted access to different areas based on where the passenger input originated. The ability to easily modify the stored data (which is accessed to determine whether access is granted to a desired destination floor) means that the current invention allows more flexibility in building use. A building that was once used for low security offices, could be turned into a multi-purpose building, even housing higher-security tenants without the need to add additional elevators or security systems to accommodate the higher-security tenants.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A method of controlling access to floors within a building via elevators, the method comprising:

receiving a passenger input at a floor of the passenger input indicating a desired destination floor a passenger seeks to travel to in an elevator;

accessing a stored database containing data about which floors passengers are allowed to access via elevator when coming from the floor of the passenger input;

determining if access is allowed based upon the floor of the passenger input, the desired destination floor and the data; and controlling operation of the elevator to deliver the passenger to the desired destination floor if access is allowed;

wherein the data includes one of open access, no access and authorization required for access for each combination of floor of the passenger input and desired destination floor.

2. The method of claim 1, and further comprising controlling operation of the elevator to not deliver the passenger to the desired destination floor if access is not allowed.

3. The method of claim 1, wherein determining if access is allowed comprises:

registering the floor of the passenger input;

registering the desired destination floor of the passenger;

comparing the desired destination floor with data stored in the database containing information about which floors passengers are allowed to access based on the floor of the passenger input; and allowing access if the desired destination floor is one of the floors which passengers are allowed to access from the floor of the passenger input.

4. The method of claim 3, wherein the database containing data can be modified.

5. The method of claim 1, and further comprising receiving an input that provides passenger information about the passenger.

6. The method of claim 5, wherein the passenger information received through the input allows the passenger to be allowed to access certain floors.

7. The method of claim 1, wherein determining if access is allowed is done by an elevator controller.

8. The method of claim 1, wherein a passenger enters a desired destination floor when calling the elevator.

9. The method of claim 1, wherein a passenger enters a desired destination floor after entering the elevator.

10. The method of claim 9, wherein if access is not allowed to the desired destination floor elevator does not move and elevator doors remain open on call floor.

11. An elevator system, the system comprising:

an elevator for transporting a passenger from one floor to another floor within a building;

an input device at a floor of a passenger input where a passenger can input a desired destination floor; and a system for controlling access to floors by the passenger in the elevator, wherein desired destination floor access is allowed or not allowed based on accessing a stored database containing data about which floors elevators are allowed to access when coming from the floor of the passenger input;

wherein the data includes one of open access, no access and authorization required for access for each combination of floor of the passenger input and desired destination floor.

12. The system of claim 11, wherein the system for controlling access to floors by elevators is a security system that interfaces with an elevator controller.

13. The system of claim 11, wherein the system for controlling access to floors by elevators is an elevator controller.

14. The system of claim 11, wherein if floor access is allowed, the elevator transports the passenger to a desired destination floor.

15. The system of claim 11, wherein if floor access is not allowed, the elevator does not transport the passenger to a desired destination floor.

16. The system of claim 11, and further comprising an input device to input passenger information about the passenger who is requesting elevator service.

17. The system of claim 16, wherein the information received through the input device allows the passenger to be allowed access to certain floors.

* * * * *